US006014847A

United States Patent [19]

Phillips

[11] Patent Number: 6,014,847

[45] Date of Patent: Jan. 18, 2000

[54] LAMINATED ROOFING SHINGLE HAVING STAGGERED SHADOW LINES AND METHOD OF MAKING THE SAME

[75] Inventor: John D. Phillips, Pataskala, Ohio

[73] Assignee: Owens Corning Fiberglas Technology, Inc., Summit, Ill.

[21] Appl. No.: 09/143,897

[22] Filed: Aug. 31, 1998

[51] Int. Cl.[7] ..... E04D 1/28

[52] U.S. Cl. ..... 52/311.1; 52/314; 52/554; 52/555; 52/557; 52/745.19

[58] Field of Search ..... 52/314, 554, 555, 52/557, 559, 745.19, 311.1; D25/139

[56] References Cited

U.S. PATENT DOCUMENTS

| | | |
|---|---|---|
| D. 300,257 | 3/1989 | Stahl . |
| D. 309,027 | 7/1990 | Noone et al. . |
| D. 313,278 | 12/1990 | Noone . |
| D. 336,347 | 6/1993 | Hannah et al. . |
| D. 340,294 | 10/1993 | Hannah et al. . |
| D. 343,911 | 2/1994 | Hulett . |
| D. 369,421 | 4/1996 | Kiik et al. . |
| D. 375,563 | 11/1996 | Hannah et al. . |
| D. 376,660 | 12/1996 | Hannah et al. . |
| D. 379,672 | 6/1997 | Lamb et al. . |
| 1,256,508 | 2/1918 | Becker . |
| 1,295,360 | 2/1919 | Overbury . |
| 1,345,627 | 7/1920 | Overbury . |
| 1,898,989 | 2/1933 | Harshberger . |
| 2,196,847 | 4/1940 | Austin . |
| 3,919,823 | 11/1975 | Bradley . |
| 4,274,243 | 6/1981 | Corbin et al. . |
| 5,195,290 | 3/1993 | Hulett . |
| 5,375,387 | 12/1994 | Davenport . |
| 5,405,647 | 4/1995 | Grubka et al. . |
| 5,426,902 | 6/1995 | Stahl et al. . |
| 5,488,807 | 2/1996 | Terrenzio et al. . |
| 5,611,186 | 3/1997 | Weaver . |
| 5,624,522 | 4/1997 | Belt et al. . |
| 5,660,014 | 8/1997 | Stahl et al. . |
| 5,664,385 | 9/1997 | Koschitzky . |
| 5,666,776 | 9/1997 | Weaver et al. . |

FOREIGN PATENT DOCUMENTS

| | | |
|---|---|---|
| 66183 | 6/1990 | Canada . |
| 68259 | 3/1991 | Canada . |
| 68260 | 3/1991 | Canada . |

*Primary Examiner*—Christopher T. Kent
*Attorney, Agent, or Firm*—Inger H. Eckert; James J. Dottavio

[57] ABSTRACT

A laminated roofing shingle having staggered shadow lines comprises an underlay and an overlay attached to an underside of the overlay. The overlay has a plurality of spaced-apart tabs. An opening is defined between each one of the tabs. Portions of the underlay are exposed through the openings between the tabs. A layer of granules is disposed on the tabs and the underlay. The layer of granules on a lower portion of the overlay and on an upper portion of the overlay are substantially uniform in color and darker in color than the granules the remainder of the tabs and the underlay. The darker layers of granules produce staggered shadow lines which enhance the three-dimensional appearance of a roof surface upon which the shingles are applied. A method for making the laminated shingles comprises the steps of providing a base material, coating the base material, applying layers of granules to produce the shadow lines, cutting the fiberglass mat, and attaching the overlays and the underlays together to produce the staggered shadow lines.

20 Claims, 6 Drawing Sheets

LAMINATED ROOFING SHINGLE HAVING STAGGERED SHADOW LINES AND METHOD OF MAKING THE SAME

TECHNICAL FIELD AND INDUSTRIAL APPLICABILITY OF THE INVENTION

This invention relates to roofing shingles and a method of making roofing shingles. More particularly, the invention relates to laminated roofing shingles having staggered shadow lines and a method of making such shingles. The staggered shadow lines enhance the three dimensional appearance of a roof surface bearing laminated shingles.

BACKGROUND OF THE INVENTION

Asphalt or composite shingles are one of the most commonly used roofing products. Asphalt shingles generally include a base material made from organic felt or a fiberglass mat. The base material serves as a matrix to support an asphalt coating and gives the shingle strength. The asphalt coating is formulated for the particular service application. The asphalt coating has a long-term ability to resist weathering and provides stability under extreme temperature conditions. An outer layer of granules is applied to the asphalt coating to form an outer surface, which shields the asphalt coating from direct sunlight. The granules also offer resistance to fire. When manufacturing colored shingles, colored granules may be applied to the asphalt coating.

Although asphalt shingles offer significant advantages over wood shingles with respect to cost, service life, and fire-resistance, wood shingles are often preferred because of the pleasing aesthetic appearance of the wood shingle roof. An important aesthetic advantage of the wood shingle as compared to an asphalt shingle is attributed to the thickness of the wood shingle. The thickness of wood shingles produces a finished roof having a layered look with depth.

Various asphalt shingles attempt to provide an appearance of thickness comparable to that of wood shingles. Examples of such asphalt shingles are shown in U.S. Pat. No. 5,666,776, issued to Casimir Paul Weaver et al., U.S. Pat. Des. No. 379,672, issued to Glenn D. Lamb et al., and U.S. Pat. Des. No. 340,294 and U.S. Pat. Des. No. 375,563, both issued to Marcia G. Hannah et al. The Weaver et al. patent shows a laminated asphalt roofing shingle having color gradations from light to dark. The color gradations create the illusion of depth or thickness. The Lamb et al. patent shows a double-shadow shingle design comprising six generally rectangular areas of different shading with alternate shaded areas having a wide darker area or shadow line at the top and a narrow shadow line at the bottom. The Hannah et al. patents show a staggered shadow line. Some of the shadow lines are heavily shaded and some of the shadow lines are lightly shaded.

SUMMARY OF THE INVENTION

The present invention is a laminated roofing shingle having staggered shadow lines. The shingle comprises an underlay and an overlay attached to an underside of the overlay. The overlay has a plurality of spaced-apart tabs. An opening is defined between each one of the tabs. Portions of the underlay are exposed through the openings between the tabs. A layer of granules is disposed on the tabs and the underlay. The layer of granules on the lower portion of the overlay are substantially darker in color than the granules the remainder of the tabs. Similarly, a layer of granules is disposed on the underlay. The layer of granules on the upper portion of the underlay is substantially darker in color than the remainder of granules on the underlay.

In accordance with a method of the present invention for making laminated shingles, a base material is coated with asphalt. The top surface of the base material is coated with a layer of granules to provide a lighter central layer of granules and two spaced-apart layers of granules that are substantially uniform in color and darker in color than the central layer of granules. The base material is cut into two horizontal lengths or lanes. The width of each lane corresponds to the desired width of the overlay. The cut corresponds with the desired pattern for the tabs and the associated openings to produce two side-by-side overlays, each being complementary to the other. The cut is made such that the lower portions of the tabs carry the darker layer of granules. The lanes may then be cut laterally to correspond to the desired length of the overlay. An underlay may be produced in a similar manner, having its surface coated with a layer of granules to provide a lighter layer of granules on a prominent portion of its surface and a darker layer of granules along an upper minority portion of the underlay. The underlay is attached to the underside of the overlay to produce a laminated shingle having a substantially rectangular configuration. Portions of the underlay are exposed through the openings between the tabs with darker granules exposed through an upper portion of the openings.

Various objects and advantages of this invention will become apparent to those skilled in the art from the following detailed description of the preferred embodiment, when read in light of the accompanying drawings.

DETAILED DESCRIPTION AND PREFERRED EMBODIMENTS OF THE INVENTION

Figure 1:
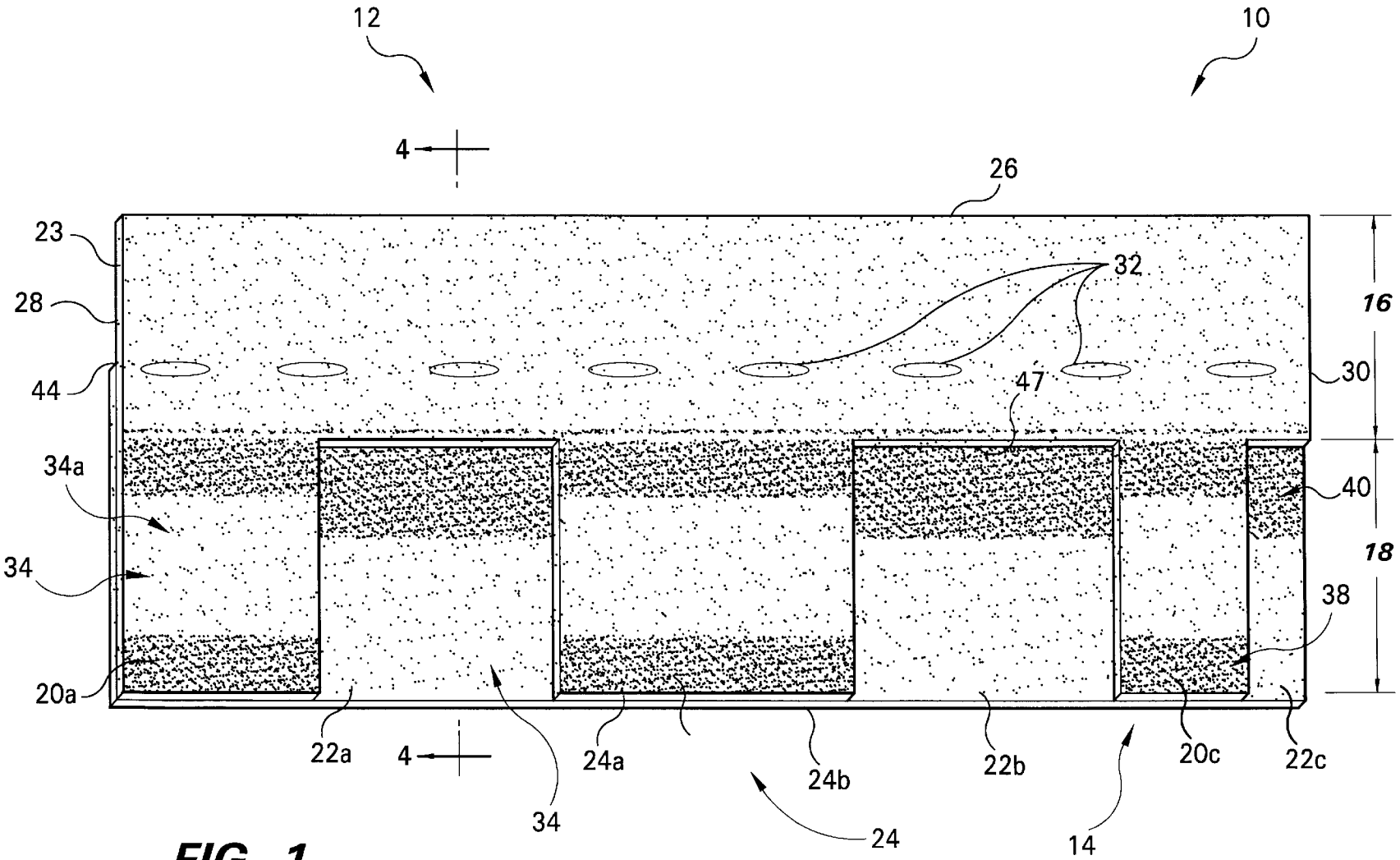
FIG. 1 is a front view of a laminated shingle of the invention.
Figure 2:
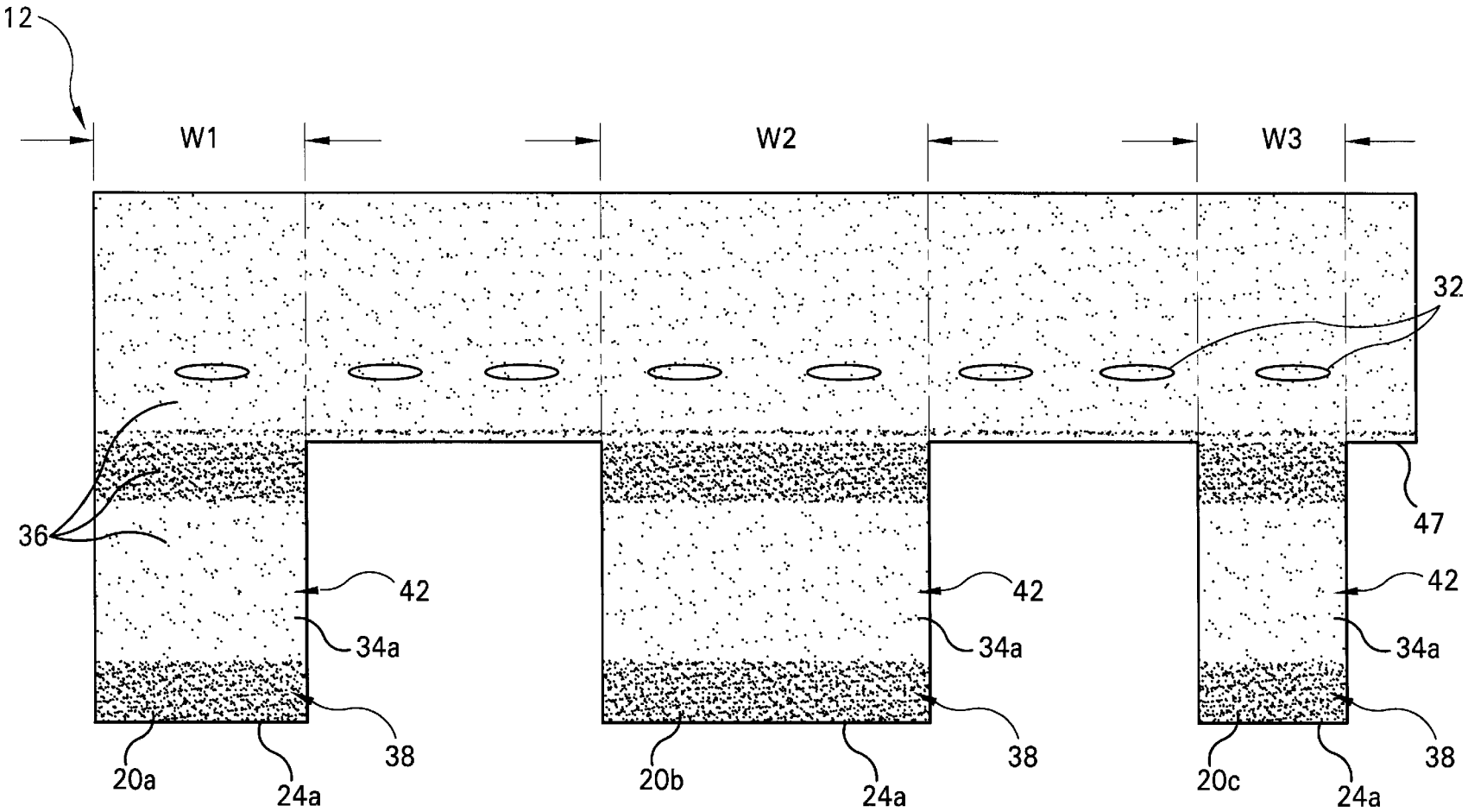
FIG. 2 is a front view of an overlay of the laminated shingle shown in FIG. 1.
Figure 3:
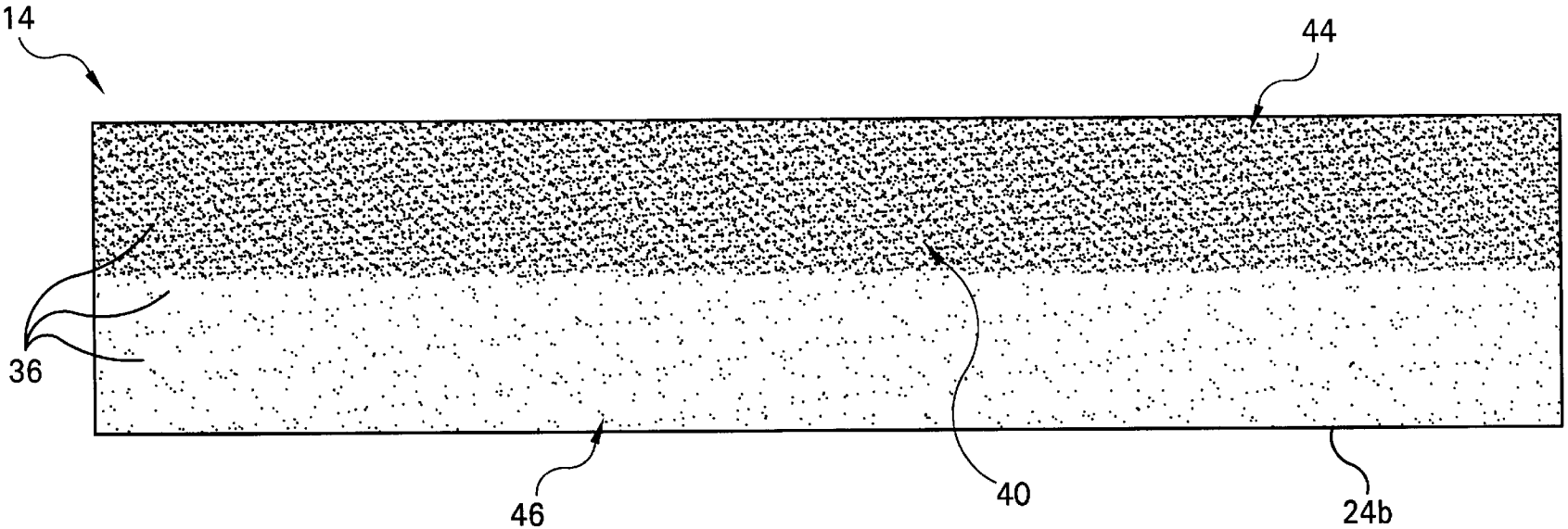
FIG. 3 is a front view of an underlay of the laminated shingle shown in FIG. 1.
Figure 4:
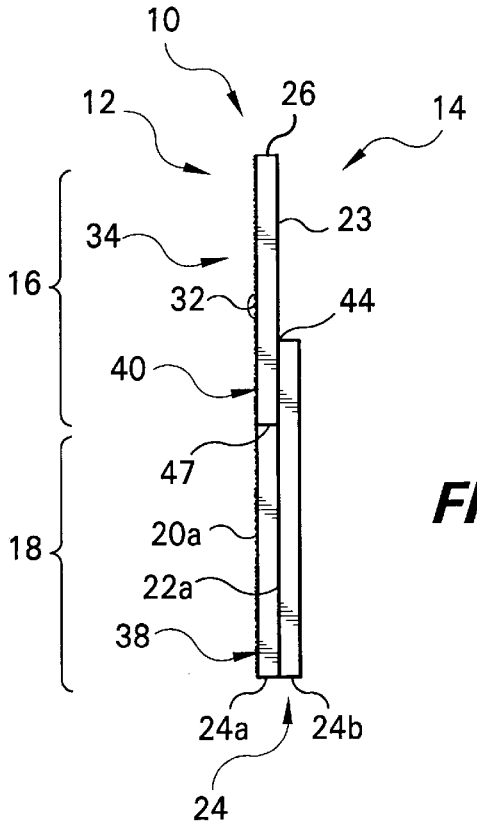
FIG. 4 is a cross-section of the laminated shingle shown in FIG. 1, taken along lines 4—4.

The description and drawings disclose laminated roofing shingles comprised of a base material and composite materials. It is to be understood that the base material can be any suitable support material. Common base materials include organic felt and fiberglass mat. It is also to be understood that the composite materials may be any suitable combination of materials. The composite materials are preferably low in cost, have a long service life, and are fire-resistant. Common composite materials include asphalt coating and mineral granules.

As shown in FIGS. 1 through 4, a laminated shingle 10 according to the invention comprises an overlay 12 and an underlay 14. The overlay 12 and underlay 14 cooperate with each other to provide a headlap section 16 and a butt section 18. The overlay 12 has a generally rectangular configuration comprising a headlap section 16. A plurality of tabs 20*a*, 20*b*, 20*c* extend from the headlap section 16 to partially form the butt section 18. Depending on the desired application and appearance of the shingles 10, the tabs 20*a*, 20*b*, 20*c* may have equal widths or different widths, such as the different widths W1, W2 shown in FIG. 2. Moreover, the tabs 20*a*, 20*b*, 20*c* may have a square, rectangular, trapezoidal or other geometric configuration. A plurality of openings 22*a*, 22*b*, 22*c* are formed between the tabs 20*a*, 20*b*, 20*c*. The underlay 14 also has a generally rectangular configuration. The underlay 14 is disposed beneath the overlay 12 and attached to an underside 23 of the overlay 12 with a portion of the underlay 14 exposed through the openings 22*a*, 22*b*, 22*c* adjacent the tabs 20*a*, 20*b*, 20*c*.

Various techniques may be used to attach the underlay 14 to the underside of the overlay 12. Typically, a laminating adhesive is used. The overlay and underlay 12 and 14 cooperate to form a resulting laminated shingle 10. This is accomplished by aligning a leading edge 24*a* of the tabs 20*a*, 20*b*, 20*c* with a leading edge 24*b* of the underlay 14. The resulting laminated shingle 10 is generally rectangular in configuration. The rectangular configuration of the laminated shingle 10 is defined in part by two spaced-apart longitudinal edges 24, 26 and two spaced-apart lateral edges 28, 30 extending between the longitudinal edges 24, 26. One of the longitudinal edges 24 defines a lower edge or leading edge of the laminated shingle 10, and is cooperatively defined by the leading edge 24*a* of the tabs 20*a*, 20*b*, 20*c* and the leading edge 24*b* of the underlay 14. A plurality of self-sealing adhesive stripes 32 are preferably disposed on the outer surface of the overlay 12 in the lower part of the headlap section 16.

In accordance with the preferred embodiment, a fiberglass mat (not shown) is provided as a base material for making the laminated shingle. During manufacture, an asphalt coating is applied to both sides of the fiberglass mat. An undersurface of the laminated shingle 10 may be coated with various inert materials with sufficient consistency to seal the asphalt coating and thus provide a non-tacky undersurface. The exposed outer surface of the laminated shingle, generally indicated in FIG. 1 at 34, is defined by the outer surface 34*a* of the tabs 20*a*, 20*b*, 20*c* and the portions of the outer surface 34*b* of the underlay 14 that are exposed through the openings 22*a*, 22*b*, 22*c* adjacent tabs 20*a*, 20*b*, 20*c*. The outer surface 34 of the laminated shingle 10 may be coated with various types of granules 36 to protect the asphalt coating and provide a fire resistant surface. The headlap section 16 of the laminated shingle 10 is generally coated with an inexpensive layer of granules. The butt section 18 of the laminated shingle 10 may be coated with a layer of colored granules to add color to the laminated shingle 10. It should be understood that granules may be of different types and characteristics, to yield different shading, sizing, and/or color arrangements.

An important feature of the laminated shingle 10 according to the present invention includes providing staggered shadow lines or darker granule zones 38, 40 on the outer surface 34 of the laminated shingle 10, as shown in FIG. 1. A first shadow line 38 is provided on the outer surface 34*a* of the tabs 20*a*, 20*b*, 20*c*, and a second shadow line 40 is provided on the outer surface 34*b* of the underlay 14. The first shadow line 38 starts at the leading edge 24*a* of the tabs 20*a*, 20*b*, 20*c* and covers a minority of the outer surface 34*a* of the tabs 20*a*, 20*b*, 20*c*. A remaining portion, or the majority of the outer surface 34*a*, of the tabs 20*a*, 20*b*, 20*c*, generally indicated in FIG. 1 at 42, is located between the first shadow line 38 and a trailing edge 62 of the tabs 20*a*, 20*b*, 20*c*. The trailing edge 62 of the tabs 20*a*, 20*b*, 20*c* is located along a side of the remaining portion 42 of the tabs 20*a*, 20*b*, 20*c* opposite the leading edge 24*a* of the tabs 20*a*, 20*b*, 20*c* and abuts portions of the leading edge 47 of the headlap section 16. The remaining portion 42 is substantially lighter in color than the first shadow line 38. The second shadow line 40 starts at the trailing edge 44 of the underlay 14 and covers a minority of the outer surface 34*b* of the underlay 14. A remaining portion, or the majority of the outer surface 34*b*, of the underlay, generally indicated at 46, is located between the leading edge 24*b* of the underlay 14 and a trailing edge 44 of the underlay 14. The remaining portion 46 is substantially lighter in color than the second shadow line 40. The remaining portions 42, 46 preferably comprise 80–92 percent of their respective outer surfaces 34*a*, 34*b*. Portions of the outer surface 34*b* of the underlay 14 are exposed through the openings 22*a*, 22*b*, 22*c* adjacent tabs 20*a*, 20*b*, 20*c* with the second shadow line 40 disposed adjacent a leading edge 47 of the headlap section 16. The first shadow line 38 on the leading edge 24*a* of the overlay 12 and the second shadow line 40 on the trailing edge 44 of the underlay 14 provide staggered shadow lines 38, 40. The darker granules forming the shadow lines 38, 40 of the laminated shingle 10 are seen in marked contrast to the lighter granules on the remaining portions 42, 46 of the laminated shingles 10. The granules forming the shadow lines 38, 40 are preferably fine black granules.

Figure 5:
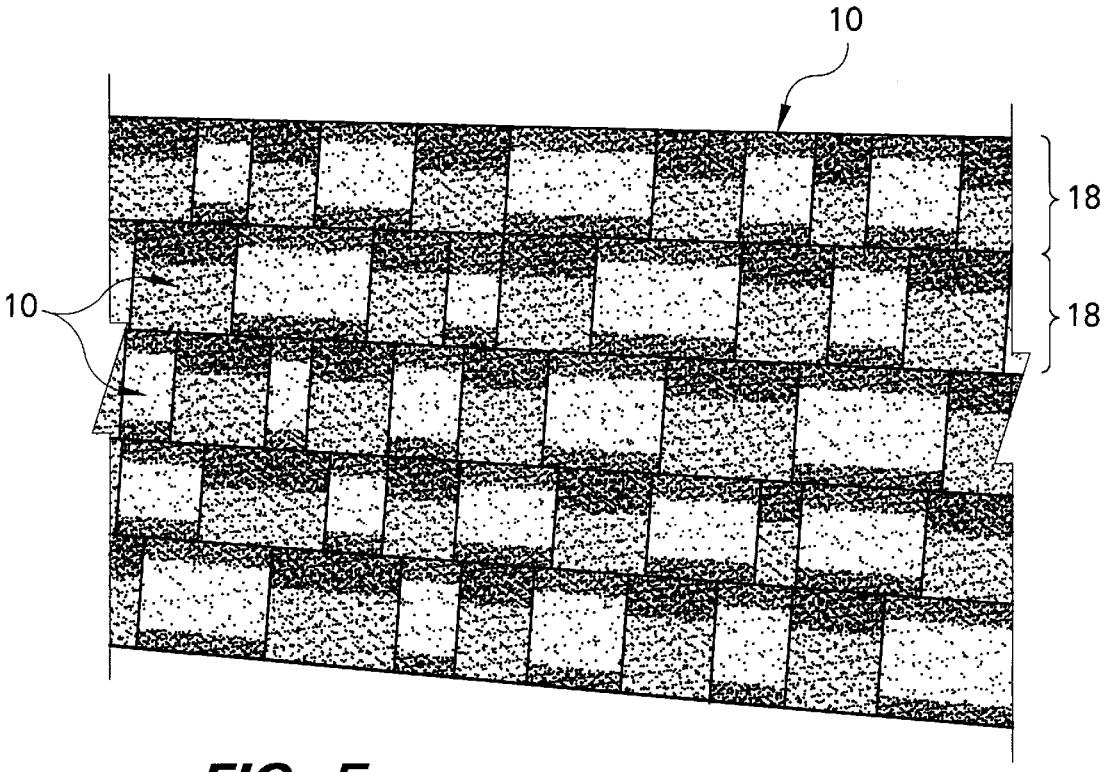
FIG. 5 is a perspective view of a plurality of overlapping laminated shingles.

As illustrated in FIG. 5, a plurality of laminated shingles 10 may be installed on the surface of a roof or other structure (not shown) to provide protection for the surface against the weather and provide an aesthetically appealing appearance for the surface. A normal procedure for installing the laminated shingles 10 includes placing the singles on the surface of the roof in an overlapping configuration. Typically, the butt section 18 of one laminated shingle 10 will be disposed in an overlapping manner on the headlap section 16 of laminated shingles of the lower or previously laid course of shingles. Stripes 32 of tab sealant material are used to secure the overlapping laminated singles 10 to each other.

Figure 6:
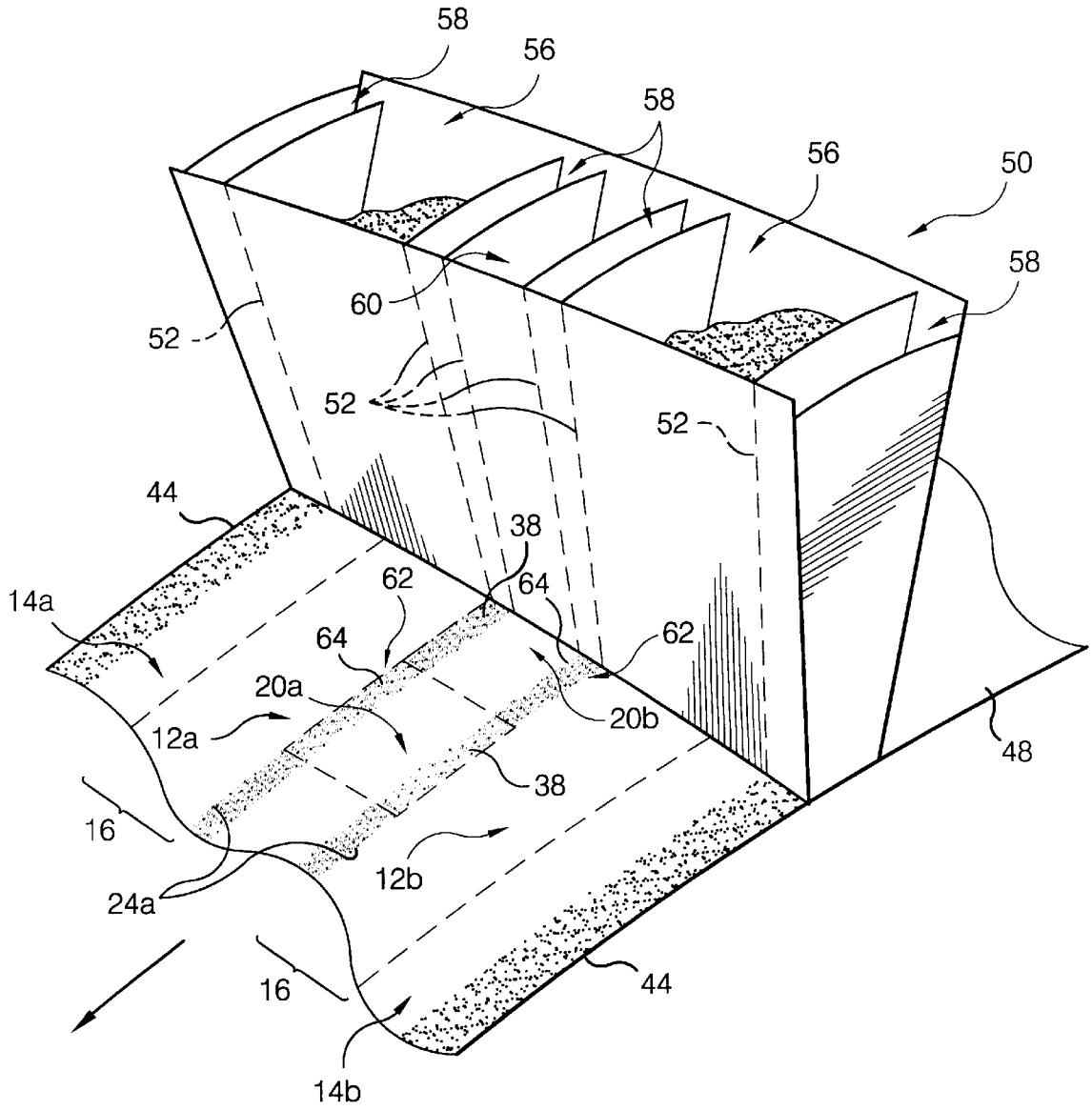
FIG. 6 is a perspective view of a base material being cut into two horizontal lengths wherein the cut corresponds with the desired pattern for the tabs and the associated openings to produce two side-by-side overlays, each being complementary to the other.
Figure 7:
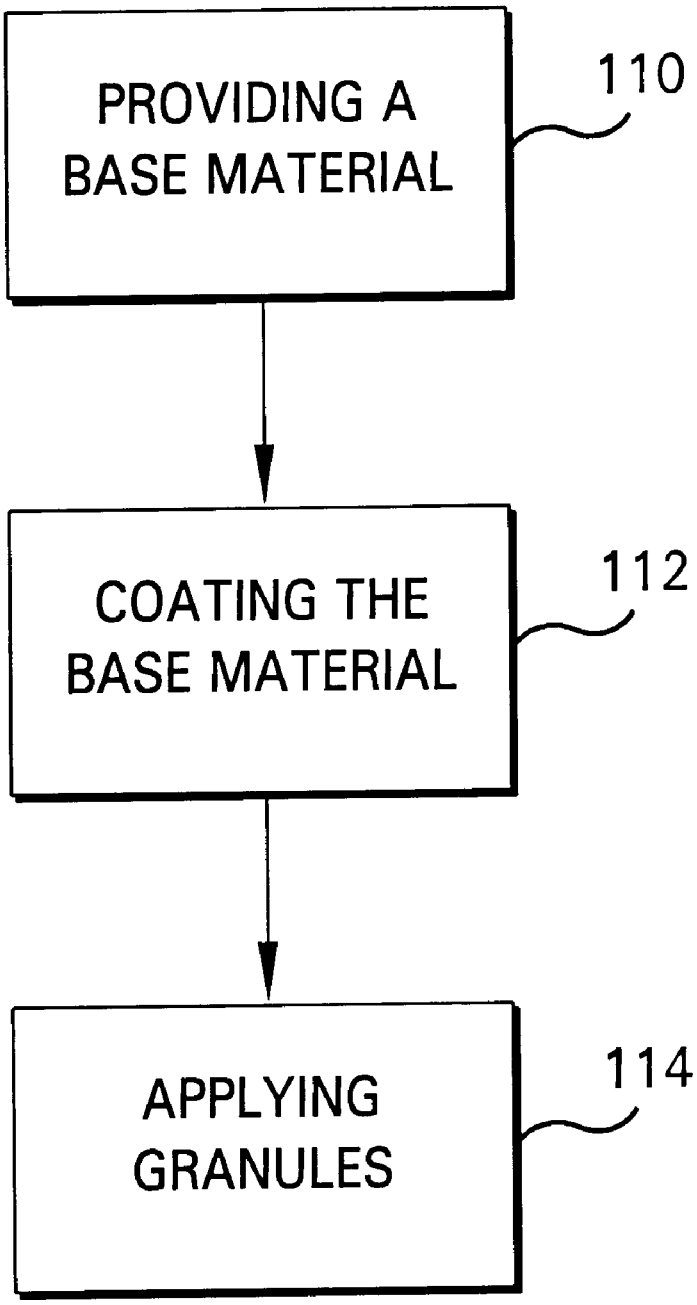
FIG. 7 is a flow chart of a method of making a laminated shingle according to the invention.

A method for making laminated shingles 10 of the invention is best understood with reference to FIGS. 6 and 7. The method comprises the step 110 of providing a base material, such as shingle mat (not shown). Although various types of shingle mat may be provided, a fiberglass mat is preferred.

It is preferable that the fiberglass mat be provided from a jumbo roll to permit of series of laminated shingles 10 to be continually made through a continuous process. It is also preferred that the fiberglass mat have a width corresponding to the width of two overlays and/or two underlays. In this way, two laminated shingles 10 can be made side-by-side from a single shingle mat, as shown in FIG. 6, with tabs 20*a*, 20*b*, 20*c* and openings 22*a*, 22*b*, 22*c* of one overlay 12*a* forming complementary tabs and openings of another overlay 12*b*.

The method for making laminated shingles 10 further comprises the step 112 for coating the fiberglass mat. The fiberglass mat is preferably coated with asphalt coating. The asphalt coating both coats the glass fibers and fills the void spaces between the glass fibers. Powdered limestone (not shown) may be applied to the undersurface of the fiberglass mat after the asphalt-coating provide a dry, non-tacky underside for the asphalt coating. It should be understood that various inert materials may be substituted for, or used in combination with, the powdered limestone for this purpose.

Following the asphalt-coating step 112, the method of the invention comprises the step 114 of applying a layer of granules to the outer surface of the tacky asphalt coated fiberglass mat indicated in FIG. 6 at 48. Lower cost granules may be applied to portions of the fiberglass mat corresponding to the headlap section 16 of the overlay 12. Darker colored granules should be applied to portions of the fiberglass mat corresponding to the leading edge 24*a* of the tabs 20*a*, 20*b*, 20*c* to form the first shadow line 38. Darker colored granules are also applied to the trailing edge 44 of the underlay 14 to form a second shadow line 40. Lighter colored granules should be applied to the remaining portions of the fiberglass mat. FIG. 6 shows a schematic representation of a storage bin or hopper 50 that may be used to apply the desired surface coating to the fiberglass mat. The hopper 50 includes a plurality of partitions 52 which divide the hopper 50 into a plurality of compartments 56, 58, 60. Some of the compartments 56 of the hopper 50 contain lower cost granules that are applied to portions of the asphalt-coated fiberglass mat 48 corresponding to the headlap section 16 of the overlay 12. Some of the compartments 58 of the hopper 50 contain darker granules which are applied to portions of the fiberglass mat corresponding to the leading edge 24*a* of the tabs 20*a*, 20*b*, 20*c* and on the trailing edge 44 of the underlay 14. The other compartments 60 of the hopper 50 contain lighter granules that are applied to the remaining portions 42, 46 of the fiberglass mat. It is to be understood that the blend drops (not shown) can also be applied to the remaining portions 42, 46.

As previously noted, an important feature of the present invention includes providing at least one portion 38, 40 of the outer surface 34*a*, 34*b* of the tabs 20*a*, 20*b*, 20*c* and the underlay 14 with a relatively uniform mix of darker color granules. The remaining portions 42, 46 of the outer surface 34*a*, 34*b* of the tabs 20*a*, 20*b*, 20*c* and the underlay 14 include a uniform mix of lighter color granules in contrast to the shadow lines 38, 40. The shadow lines 38, 40 create the appearance of depth or thickness when the shingles are installed on the roof Following the granule applying step 114, the method comprises the step of cutting the fiberglass mat to form the overlays 12*a*, 12*b* and underlays 14*a*, 14*b*. As shown by dotted lines in FIG. 6, the fiberglass mat may be cut into two or four horizontal lengths or lanes. Two of the lanes overlap and have widths corresponding to the desired widths of the overlays 12*a*, 12*b*. The widths of the other two lanes correspond to the desired widths of the underlays 14*a*, 14*b*. The lanes may then be cut laterally to correspond to the desired length of the overlays 12*a*, 12*b* and the underlay 14*a*, 14*b*. The cut along the central dotted line corresponds with the desired pattern for the tabs 20*a*, 20*b*, 20*c* and the associated openings 22*a*, 22*b*, 22*c*.

As shown in FIG. 6, each lateral cut of the fiberglass mat results in two overlays 12*a*, 12*b* and two underlays 14*a*, 14*b* which may be assembled with each other to form two laminated shingles 10. The resultant laminated shingles 10 are then packaged for future installation on the surface of a roof. It is to be understood that the underlays could be manufactured in a separate process.

In accordance with the foregoing method, when making two complementary overlays 12*a*, 12*b* side-by-side, not only is shadow line 38 created at the leading edge 24*a* of each tab 20*a*, 20*b*, 20*c*, but also a thin shadow line 64 will be applied to the trailing edge 62 of the tabs 20*a*, 20*b*, 20*c*. It is also preferable that the second shadow line 40 on the underlay be wider than the shadow line 64 on the trailing edge 62 of the tabs 20*a*, 20*b*, 20*c*. For example, the second shadow line 40 can be 1 to ¾ inches wide and the shadow line 64 on the trailing edge 62 of the tabs 20*a*, 20*b*, 20*c* can to ½ to ⅜ inch wide, respectively, for standard size shingles. This is to provide a marked demarcation between the second shadow line 40 and the shadow line 64 (shown in FIG. 1) on the trailing edge 62 of the tabs 20*a*, 20*b*, 20*c*.

It should be understood that the granules of the laminated shingle 10 according to present invention may be placed on the shingles using various procedures and various types of materials. The present invention is not limited to shingles formed by the process shown in FIGS. 6 and 7.

The principle and mode of operation of this invention have been described in its preferred embodiments. However, it should be noted that this invention may be practiced otherwise than as specifically illustrated and described without departing from its scope.

What is claimed is:

1. A laminated roofing shingle comprising:

an overlay having an underside and a plurality of spaced apart tabs, each one of said tabs having a leading edge, a first shadow line and a remaining portion, said tabs defining openings adjacent said tabs;

a layer of granules disposed on said first shadow line of said tabs and on said remaining portion of said tabs, said granules on said first shadow line of said tabs being substantially darker in color than said granules on said remaining portion of said tabs;

an underlay attached to said underside of said overlay to cooperatively form said laminated roofing shingle, said underlay having a leading edge, a second shadow line, and a remaining portion between said leading edge of said underlay and said second shadow line, said leading edge of said underlay generally co-aligning with said leading edge of said tabs, said underlay having a portion exposed through said openings defined adjacent said tabs; and a layer of granules disposed on said underlay, said granules on said second shadow line of said underlay being substantially darker than said granules on said remaining portion of said underlay.

2. A laminated roofing shingle according to claim 1, wherein each one of said tabs further has a trailing edge on a side of said remaining portion of said tabs opposite said leading edge of said tabs, said granules on said first shadow line and said granules on said shadow line on said trailing edge of said tabs being generally uniform in color, said shadow line on said trailing edge of said tabs being substantially narrow relative to said shadow line on said trailing edge of said underlay.

3. A laminated roofing shingle according to claim 1, wherein said first shadow line defines a minority portion of said tabs and said second shadow line defines a minority portion of said underlay, said remaining portion of said tabs defining a majority portion of said tabs and said remaining portion of said underlay defining a majority portion of said underlay.

4. A laminated roofing shingle according to claim 1, wherein said overlay and said underlay are each formed from a base material comprising a fiberglass mat that has been coated with asphalt.

5. A laminated roofing shingle according to claim 1, wherein said granules on said first shadow line and said granules on said second shadow line are black granules.

6. A laminated roofing shingle according to claim 1, wherein said first shadow line is generally narrow relative to said second shadow line.

7. A laminated roofing shingle comprising:

an overlay having an underside, a headlap section and a plurality of spaced apart tabs extending from said headlap section, said headlap section having a leading edge, each one of said tabs having a leading edge, an outer surface, a first shadow line and a remaining portion, said first shadow line and said remaining portion being on said outer surface of said tabs, said first shadow line extending from said leading edge of said tabs to said remaining portion of said tabs, said tabs and said leading edge of said headlap section defining openings;

a layer of granules disposed on said first shadow line of said tabs and on said remaining portion of said tabs, said granules on said first shadow line of said tabs being substantially darker in color than said granules on said remaining portion of said tabs;

an underlay attached to said underside of said overlay to cooperatively form said laminated roofing shingle, said underlay having an outer surface, a leading edge, a trailing edge, a second shadow line, and a remaining portion between said leading edge of said underlay and said second shadow line, said leading edge of said underlay generally co-aligning with said leading edge of said tabs, said second shadow line and said remaining portion of said underlay being on said outer surface of said underlay, said second shadow line extending from said trailing edge of said underlay to said remaining portion of said underlay, said underlay having a portion exposed through said openings defined by said tabs and said leading edge of said headlap section, said second shadow line being exposed through said opening and adjacent said leading edge of said headlap section; and a layer of granules disposed on said underlay, said granules on said second shadow line of said underlay being substantially darker than said granules on said remaining portion of said underlay.

8. A laminated roofing shingle according to claim 7, wherein each one of said tabs further has a trailing edge on a side of said remaining portion of said tabs opposite said leading edge of said tabs, and a shadow line on said trailing edge of said tabs, said granules on said first shadow line and said granules on said shadow line on said trailing edge of said tabs being substantially uniform in color, said shadow line on said trailing edge of said tabs being generally narrow relative to said shadow line on said trailing edge of said underlay.

9. A laminated roofing shingle according to claim 7, wherein said overlay and said underlay are each formed from a base material comprising a fiberglass mat that has been coated with asphalt.

10. A laminated roofing shingle according to claim 7, wherein said granules on said first shadow line and said granules on said second shadow line are black granules.

11. A laminated roofing shingle according to claim 7, wherein said first shadow line is generally narrow relative to said second shadow line.

12. A method of making laminated roofing shingle having an overlay and an underlay formed from a base material having an outer surface and an undersurface, the overlay having tabs and openings defined adjacent the tabs, the tabs having leading edges, the underlay having a trailing edge, said method comprising the steps of:

(a) coating a base material to produce a coated base material;

(b) forming a granule-covered sheet by applying a layer of granules to the outer surface of the coated base material so as to apply darker granules to portions of the base material corresponding to the leading edge of the tabs of the resultant laminated shingle and on the trailing edge of the underlay of the resultant laminated shingle and apply lighter colored granules to remaining portions of the tabs and the underlay; and (c) cutting the granule covered sheet to form the overlay of the resultant laminated shingle and the underlay of the resultant laminated shingle.

13. A method according to claim 12, wherein said base material is a fiberglass mat comprising glass fibers and void spaces between the glass fibers and said coating steps includes coating the glass fibers and filling the void spaces between the glass fibers.

14. A method according to claim 13, wherein said coating is an asphalt coating.

15. A method according to claim 14, wherein said coating step further comprises the step of:

applying inert materials to the undersurface of the coated fiberglass mat to make the undersurface non-tacky.

16. A method according to claim 14, wherein said coating step further comprises the step of:

applying powdered limestone to the undersurface of the fiberglass mat to make the undersurface non-tacky.

17. A method according to claim 12, wherein said cutting step further comprises the steps of:

(a) cutting the granule covered sheet into two overlapping horizontal lanes, each lane having a width corresponding to the width of the overlay of the resultant laminated shingle; and (b) cutting the base material laterally at lengths corresponding to the length of the overlay of the resultant laminated shingle.

18. A method according to claim 16, wherein said cutting step further includes cutting the base material along a pattern to produce tabs and openings of the overlays of the resultant laminated shingle of two side-by-side overlays, wherein each overlay is complementary to the other overlay.

19. A method according to claim 12, wherein said cutting step further comprises the steps of:

(a) cutting the granule covered sheet into four horizontal lanes including two overlapping inner lanes each having a width corresponding to the width of the overlay of the resultant laminated shingle and two outer lanes each having a width corresponding to the width of the underlay of the resultant laminated shingle; and (b) cutting the granule covered sheet laterally at lengths corresponding to the length of the overlay and the underlay of the resultant laminated shingle, the overlay and the underlay being substantially the same length.

20. A method according to claim 18, wherein said cutting step further includes cutting the base material along a pattern to produce tabs and openings of the overlays of the resultant laminated shingle of two side-by-side overlays, wherein each overlay is complementary to the other overlay.

* * * * *